US011998788B2

(12) United States Patent
Kerdjoudj

(10) Patent No.: US 11,998,788 B2
(45) Date of Patent: Jun. 4, 2024

(54) LOW PROFILE PORTABLE EXERCISE MACHINE WITH DUAL RESISTANCE

(71) Applicant: Mohamed Kerdjoudj, Aurora, IL (US)

(72) Inventor: Mohamed Kerdjoudj, Aurora, IL (US)

(73) Assignee: Mohamed Kerdjoudj, Aurora, IL (US)

( * ) Notice: Subject to any disclaimer, the term of this patent is extended or adjusted under 35 U.S.C. 154(b) by 106 days.

(21) Appl. No.: 17/499,446

(22) Filed: Oct. 12, 2021

(65) Prior Publication Data

US 2022/0111240 A1 Apr. 14, 2022

Related U.S. Application Data

(63) Continuation-in-part of application No. 29/754,565, filed on Oct. 13, 2020.

(51) Int. Cl.

| | |
|---|---|
| ***A63B 21/04*** | (2006.01) |
| ***A63B 21/00*** | (2006.01) |
| ***A63B 21/068*** | (2006.01) |
| ***A63B 22/20*** | (2006.01) |

(52) U.S. Cl.

CPC .... *A63B 21/0442* (2013.01); *A63B 21/00069* (2013.01); *A63B 21/068* (2013.01); *A63B 21/4034* (2015.10); *A63B 22/203* (2013.01)

(58) Field of Classification Search

CPC ..... A63B 21/0442; A63B 21/00069; A63B 21/068; A63B 21/4034; A63B 22/203; A63B 21/0051; A63B 22/20; A63B 2022/0033; A63B 2208/0233; A63B 2220/17; A63B 21/0414

See application file for complete search history.

(56) References Cited

U.S. PATENT DOCUMENTS

| | | | | | |
|---|---|---|---|---|---|
| 4,618,139 | A * | 10/1986 | Haaheim | A63B 22/0012 | 482/131 |
| 5,279,530 | A * | 1/1994 | Hess | A63B 21/154 | 482/79 |
| 5,499,958 | A * | 3/1996 | Hess | A63B 21/154 | 482/79 |
| 6,042,523 | A * | 3/2000 | Graham | A63B 22/203 | 482/79 |
| 6,569,064 | B1 * | 5/2003 | Loane | A63B 21/154 | 482/146 |
| 7,134,987 | B2 * | 11/2006 | Goldstein | A63B 21/4045 | 482/141 |
| D689,569 | S * | 9/2013 | Kerdjoudj | A63B 21/154 | D21/668 |
| D791,251 | S * | 7/2017 | Kerdjoudj | A63B 21/154 | D21/668 |
| 2009/0098983 | A1 * | 4/2009 | Hoffman | A63B 69/0022 | 482/70 |
| 2011/0183814 | A1 * | 7/2011 | Raumann | A61H 15/00 | 482/70 |
| 2013/0237393 | A1 * | 9/2013 | Kerdjoudj | A63B 21/4033 | 482/122 |
| 2019/0022456 | A1 * | 1/2019 | Dalmia | A63B 22/0046 | |

* cited by examiner

*Primary Examiner* — Andrew S Lo

(57) ABSTRACT

An exercise device comprising a foot carriage slidably mounted on tracks, the tracks are held together parallel to one another and dual magnetic and elastic resistance elements provide opposition against the relative motion of the foot carriage. The foot carriage can be a frame carrying wheels and straddle mounted by a frame structure composed of hat shaped beams for which low-profile footrests are pivotally mounted.

10 Claims, 25 Drawing Sheets

LOW PROFILE PORTABLE EXERCISE MACHINE WITH DUAL RESISTANCE

CROSS-REFERENCE TO RELATED APPLICATIONS

This application claims benefit of continuation in part of Design Patent Application Ser. No. 29/754,565, hereby incorporated by reference.

BACKGROUND OF THE INVENTION

Field of the Invention

This invention relates to exercise devices, specifically to devices that can be placed under a desk with more clearance between knees and desk for exercise of the lower body from a sitting position. This device will also allow for using magnetic and elastic resistance during exercise. It can be used while working, watching TV or involved in other activities.

Background of the Invention

The present invention is an improvement upon the U.S. Pat. No. 8,894,551. The foot carriage comprises, a footrest frame made from a plurality of hat shaped beams connected to each other by cross beam to form a rigid structure on which a pair of footrests are mounted pivotally. The footrest frame straddles a wheeled carriage frame enabling the footrests to be mounted as low as possible to the ground, thereby allowing the user to have more clearance between knees and desk during exercise. The footrests can rotate between horizontal and vertical positions. Where footrests at the horizontal position can be considered as low-profile footrests. However, the foot support in U.S. Pat. No. 8,894,551. is above the wheeled carriage frame. Another improvement is in the resistance to movement of the foot carriage along the track assembly, where both magnetic and elastic resistance can be leveraged at the same time. Two design possibilities for magnetic resistance assembly are offered in the present invention. The first option is magnets are fixed to the foot carriage and a reaction bar made from a conduction material is vertically movable to adjust the air gap for varying the resistance. The second option is a fixed reaction bar to the track assembly but a vertically movable magnet system. In both options the reaction bar is located between the two the tracks and below the foot carriage to save space and have compact design. In both options, a plurality of magnets located longitudinally beneath the wheeled carriage frame are attached to a magnet holder which has a dual function to carry the magnets and also restrain the elastic element to the foot carriage by squeezing a small portion of the elastic element under a pressure plate for which the pressure is controlled by a cap nut. Varying the elastic resistance is by varying the length of the elastic element between the retrained portion and the fixed ends at end caps. In the first option, the magnet holder is fixed to foot carriage but in the second option, it is movable through a mechanism driven by adjusting a knob on a foot carriage, thereby adjusting the magnetic resistance.

SUMMARY OF THE INVENTION

The exercise device of the present invention comprises a foot carriage constrained to roll in a forward and backward motion. The foot carriage is slidably mounted within tracks and comprises a pair of low-profile footrests for receiving a user's feet. A dual resistance: magnetic and elastic is provided to impede the foot carriage movement within a pair of tracks. A sensor attached to a reaction bar for counting the strides by using an LCD screen display meter,

DETAILED DESCRIPTION OF THE INVENTION

Figure 1:
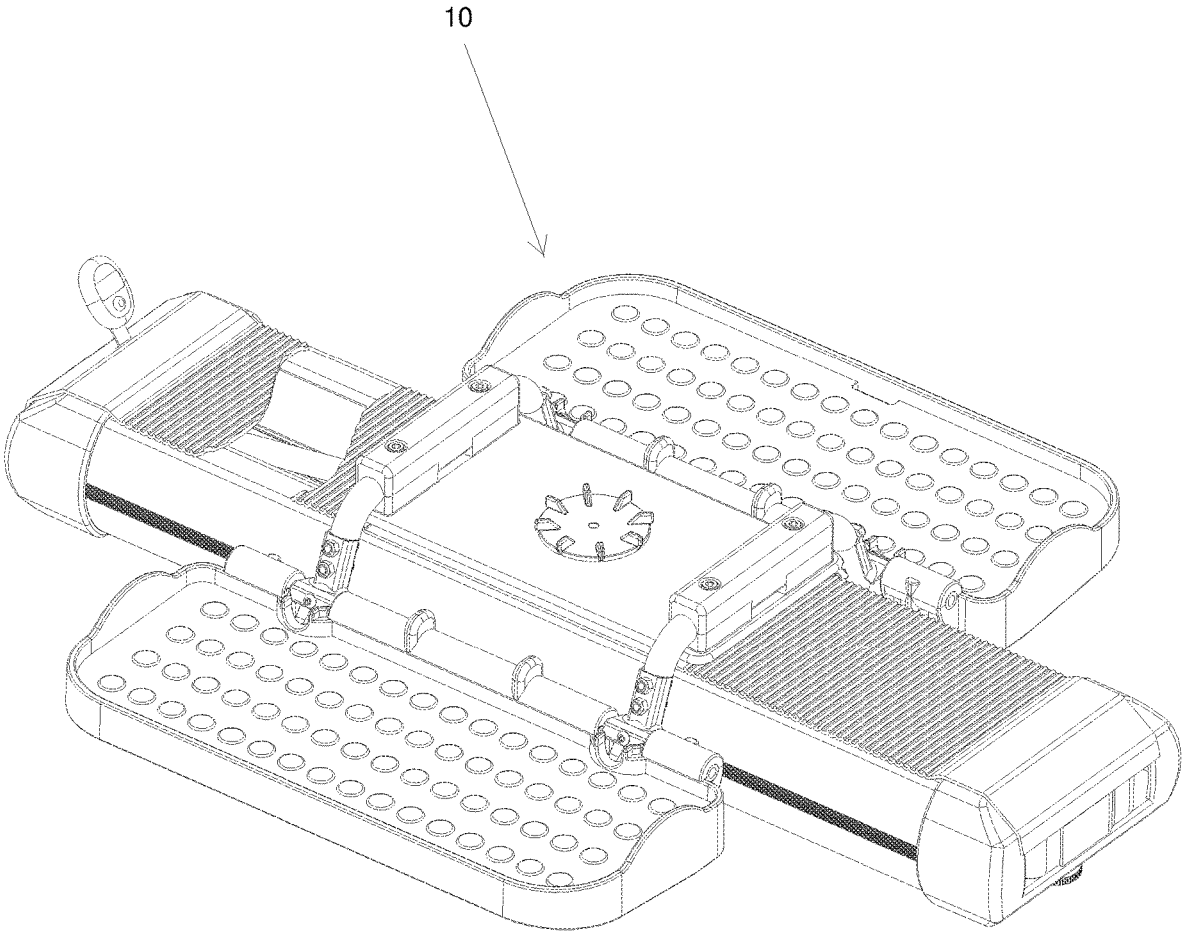
FIG. 1 is a top perspective of one embodiment of the exercise device.
Figure 2:
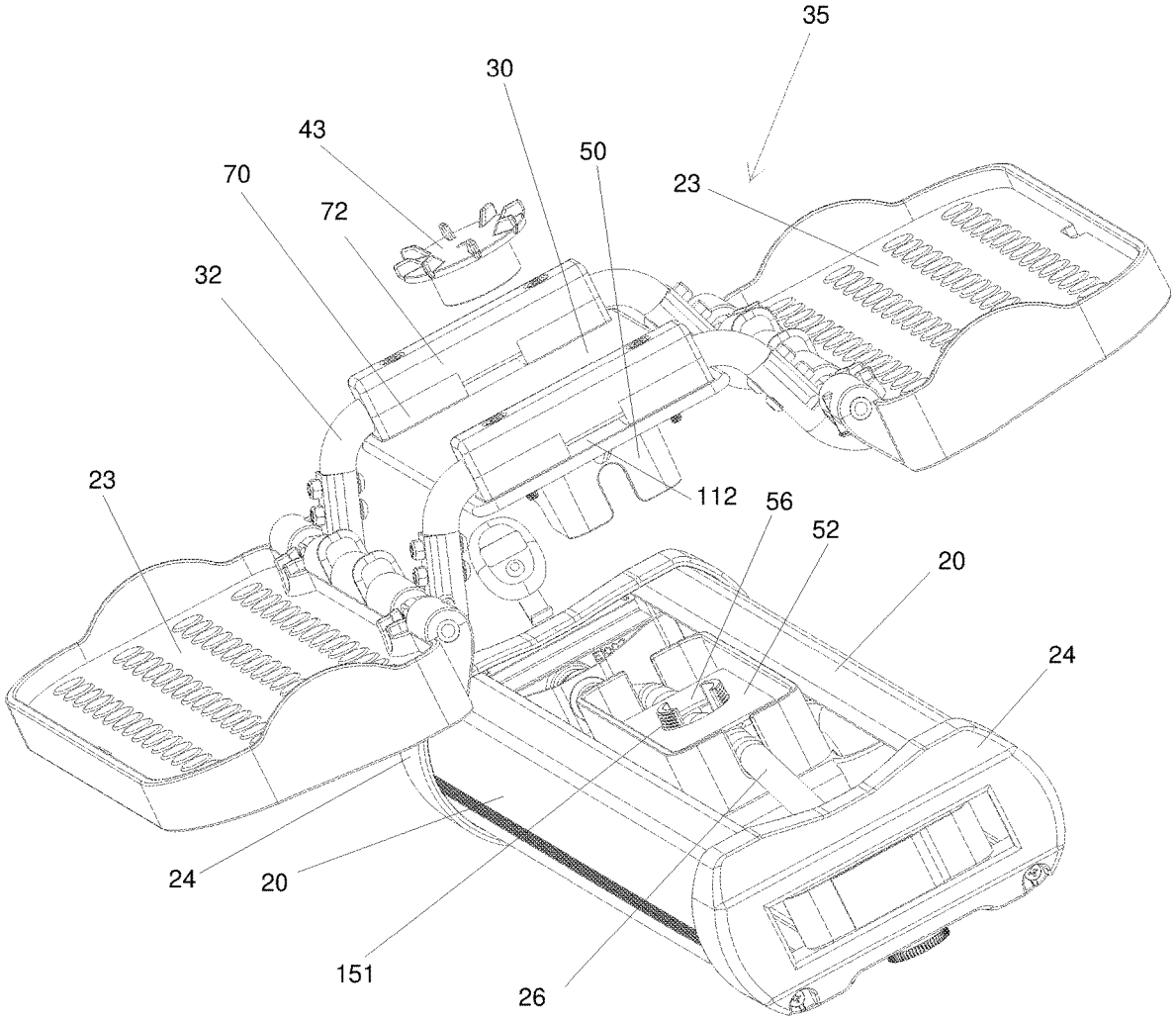
FIG. 2 is an exploded view of one embodiment of the exercise device.
Figure 3:
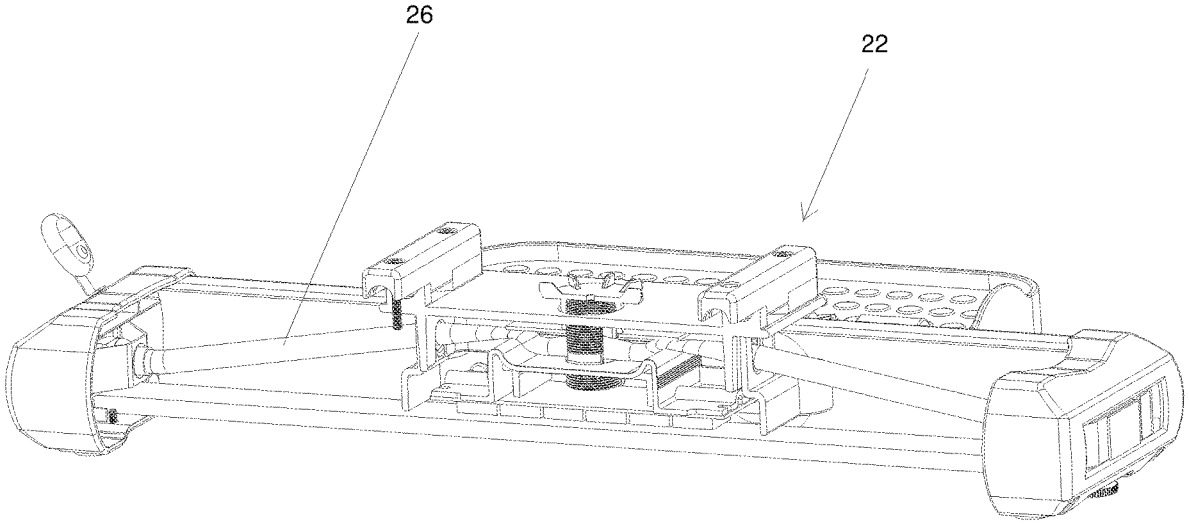
FIG. 3 is top perspective sectional view illustrating the dual resistance assembly within the whole exercise device and with one track removed for one embodiment of the exercise device.
Figure 4:
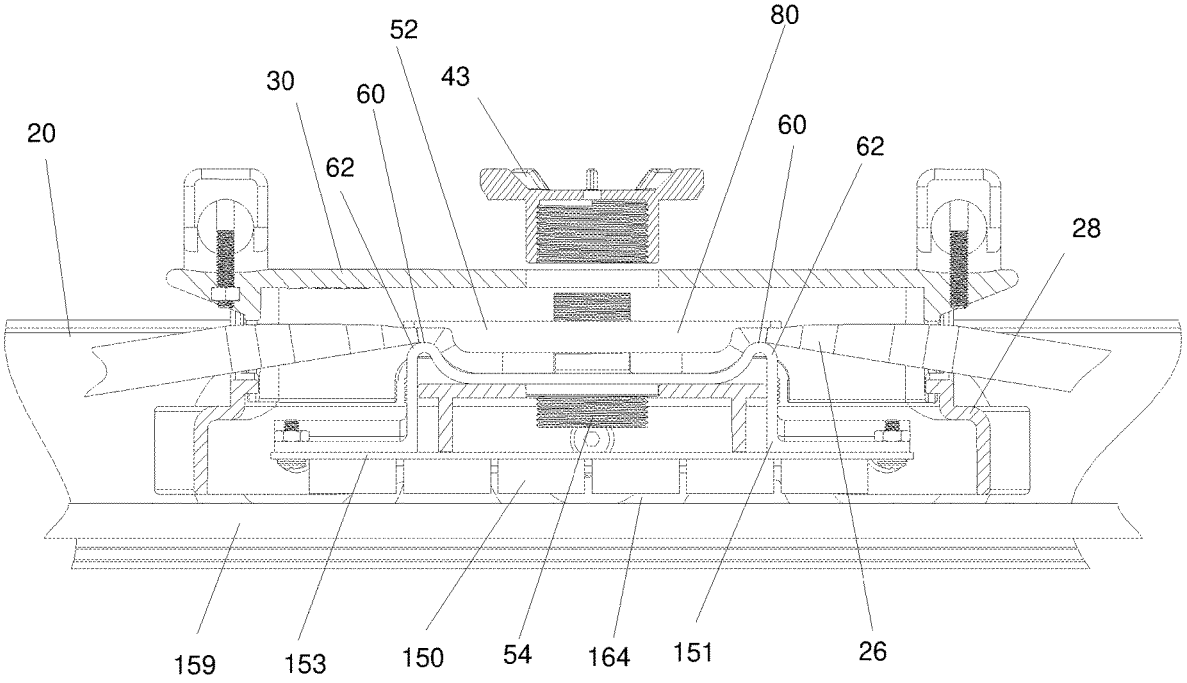
FIG. 4 is a sectional view illustrating the dual resistance assembly of one embodiment of the exercise device.
Figure 5:
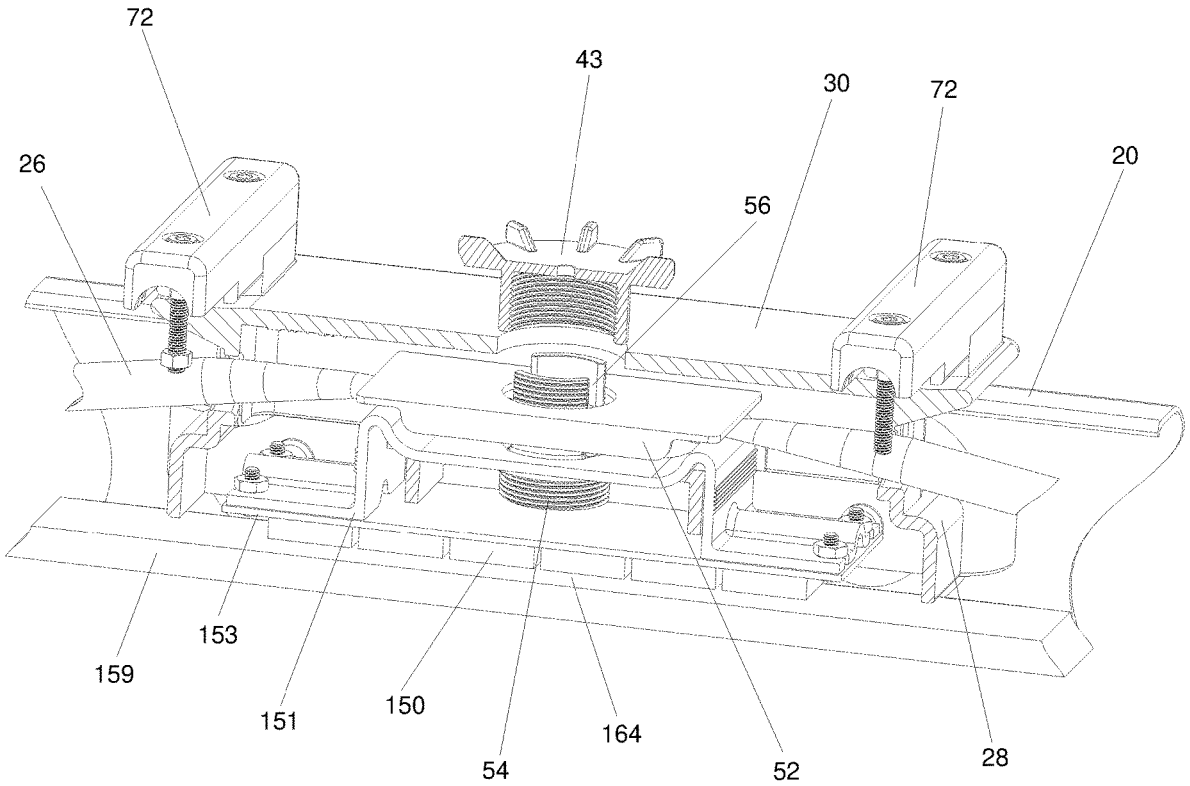
FIG. 5 is a top perspective of a sectional view illustrating the dual resistance assembly of one embodiment of the exercise device.

While the present disclosure may be susceptible to embodiment in different forms, there is shown in the drawings, and herein will be described in detail, an embodiment with the understanding that the present description is to be considered an exemplification of the principles of the disclosure and is not intended to limit the disclosure to the details of construction and arrangements of components set forth in the following description or illustrated in the drawing.

A preferred embodiment of the exercise device 10 of the present invention is illustrated in FIGS. 1-14. The device 10 comprises tracks 20, a foot carriage 22 slidably mounted within the tracks 20, a pair of end caps 24 fastened at the ends of tracks 20 to keep the tracks parallel to each other.

In one embodiment, the foot carriage 22 comprising a carriage frame 28 with first end and second end and having a plurality of wheels 104, 105 rotatably mounted thereto in such a manner as to enable the foot carriage 22 to roll along the tracks 20, a dual resistance assembly 148, and a foot support assembly 35. The dual resistance assembly 148 comprises a magnet holder 151 attached to the carriage frame 28 or can be integral with the frame 28, a plurality of magnets 150, a magnet holding plate 153, a pressure plate 52, and an elastic resistance element 26. The magnet holder having a hat shaped cross section with curved peaks 62 like dog ears and secures longitudinally to the magnet holding plate 153 by means of screws or by any other fastening method. The magnet holder has also a bottom threaded cylindrical shape 54 to receive a nut for fastening and securing to the carriage frame 28 and a top portion consisting externally threaded cylinder with a longitudinal slot 56. The magnet holding plate 153 has a rectangular shape and holds a plurality of magnets 150 having north poles and south poles laid alternately to generate a magnetic force against the reaction bar 159 to produce resistance when the foot carriage is moving within the tracks 20. The reaction bar 159 is a rectangular beam made of a conductive material such as aluminum or copper where Eddy currents are induced to create a magnetic field that opposes to the magnetic field produced by the moving magnets 150. As a result, a greater resistance is generated to oppose the moving foot carriage 22. One end of the reaction bar 159 is adjustably attached to a first end of end cap 24 while the second end of the reaction bar 159 is adjustably attached to a second end of end cap 24. In one embodiment, each end of the reaction bar 159 has a threaded hole 58 and located between the bottom wall 76 and horizontal rib 82 in the end cap 24. An adjusting tension wheel 44 with a threaded shaft extends upward through the bore 77 in the bottom wall 76 and into a threaded hole 58 in the reaction bar 159, then into the bore 84 in the horizontal rib 82. The end of the threaded shaft is held by a cotter pin or any other method not shown. Turning of the wheel 44 translates into a vertical motion of the end of the reaction bar 159. As a result, when both the wheels 44 at each end cap are adjusted then the whole reaction bar 159 is raised as in figure FIG. 6 or lowered as in FIG. 7 in order to reduce or increase the air gap 164 between the magnets 150 and the reaction bar 159. In another embodiment in FIG. 8, the adjusting knob 42 with threaded shaft extends downward from a bore 78 in the top wall 74 of the end cap 24, then into the treaded hole 58 in the reaction bar 159 and then into the bore 77 at the bottom wall 76 of the end cap 24. Turning each knob 42 will control the vertical position of the reaction bar and thereby air gap 164 to change the magnetic resistance to the moving foot carriage 22. An additional resistance is achieved through the elastic element 26 for which one end of the resistance element 26 is releasably attached to the first end cap 24 while the second end of the resistance element 26 is releasably attached to the second end cap 24. The middle portion 80 of the elastic element 26 is laid on top of the curved peaks 62 of the magnet holder. The middle portion 80 of the elastic element 26 is pressed against the curved peaks 62 of the magnet holder 151 by the pressure plate 52. The pressure is generated by turning and tightening a flanged cap nut 43 which comes in contact with the pressure plate 52. The flanged cap nut 43 threads into the top portion of magnet holder 151 and keeps the footrest board 30 attached to the carriage frame 28. The tension of the resistance element 26 can be controlled by increasing or reducing the length of the portion of the resistance element 26 between the pressure point 60 and the end cap 24. The remaining unstretched portion of resistance element 26 can be stored in the slot 56 of the threaded cylindrical top portion of the magnet holder 151.

The foot support sub-assembly 35 comprises footrest board 30, footrest frame 32, and a pair of footrests 23 for right and left foot. The footrest board 30 is a one-piece rigid or semi rigid construction having a top portion and a bottom portion 50 that engages with the carriage frame 28.

Figure 21:
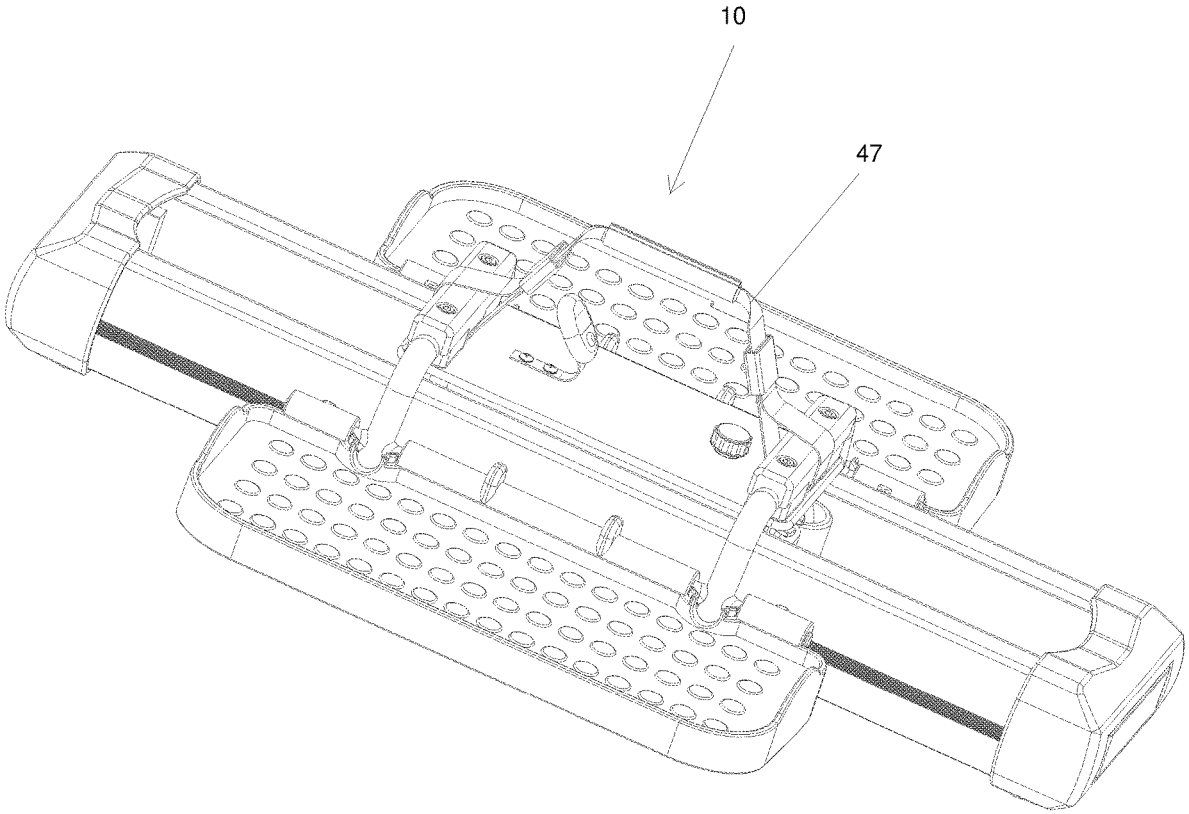
FIG. 21 is a top perspective view of a third embodiment of the exercise device.
Figure 22:
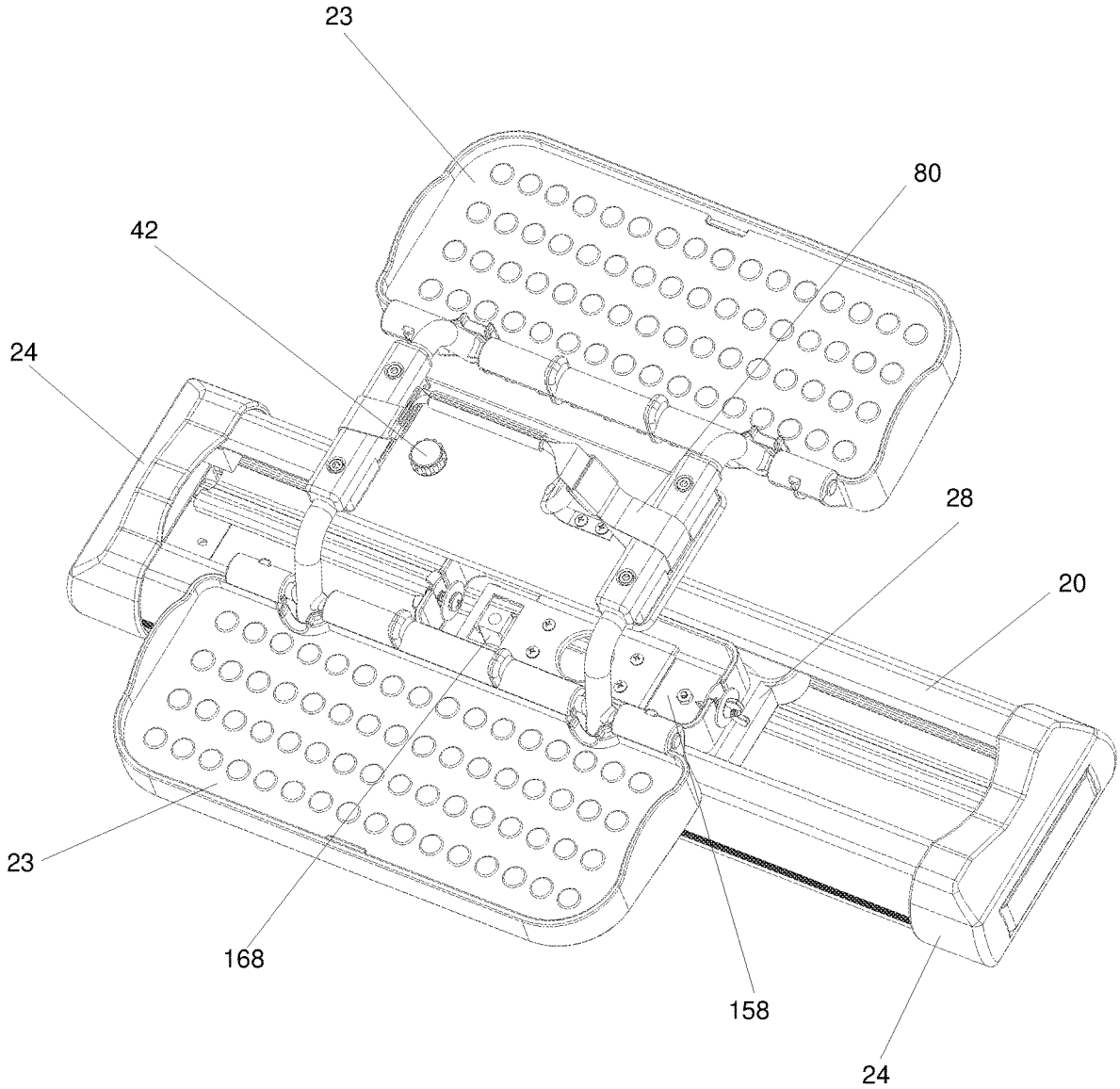
FIG. 22 is a top perspective exploded view of a third embodiment of the exercise device.
Figure 23:
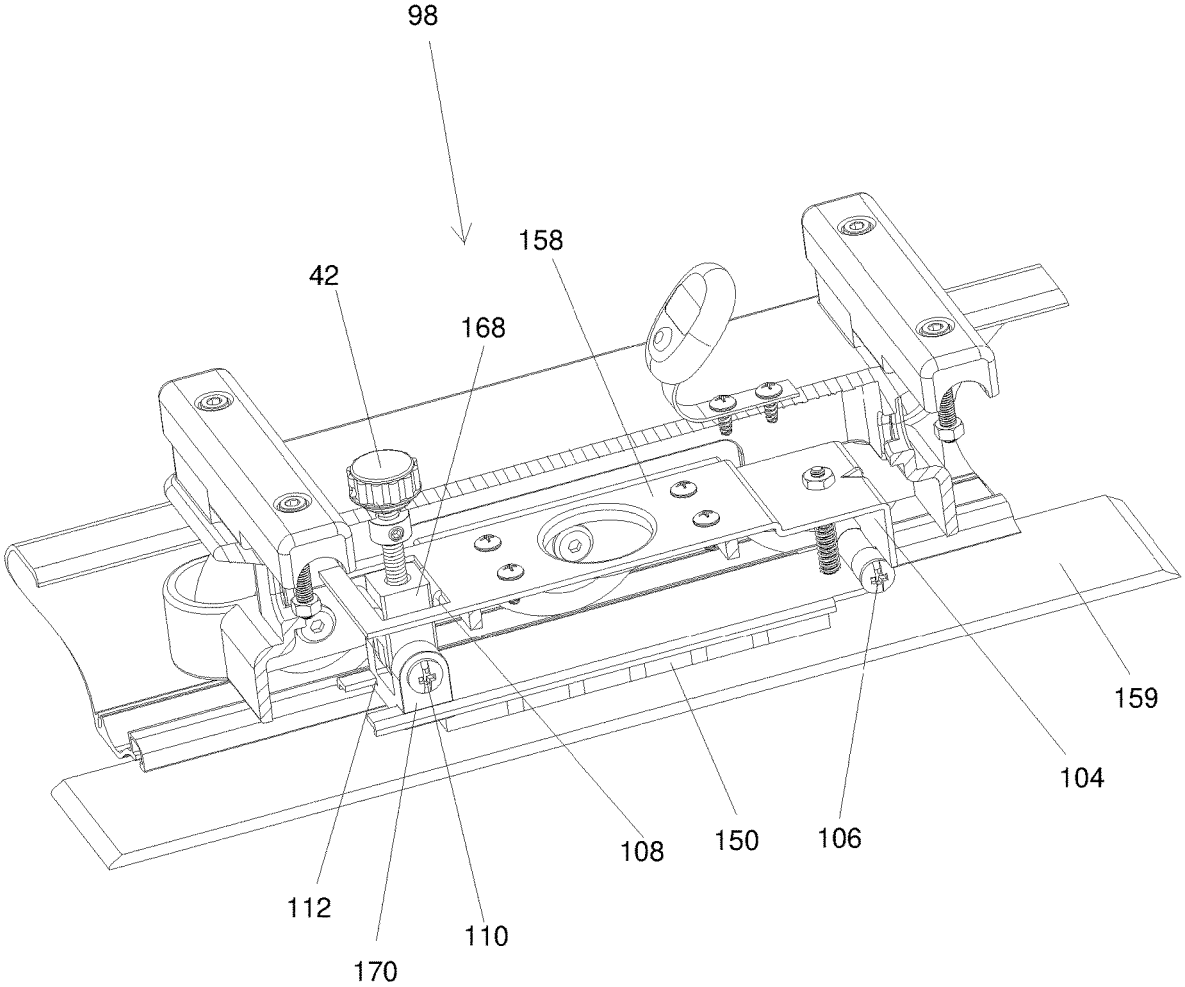
FIG. 23 is a top perspective of a sectional view illustrating the magnetic resistance assembly of third embodiment of the exercise device.
Figure 24:
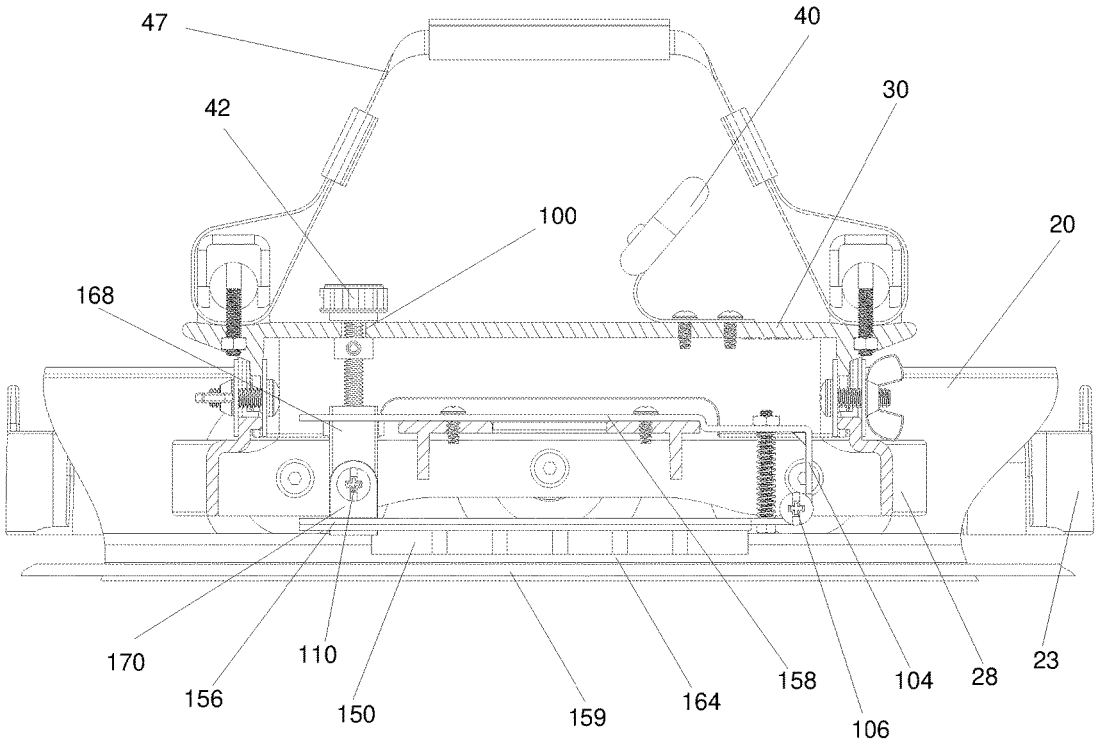
FIG. 24 is a sectional view illustrating the magnetic resistance assembly of third embodiment adjusted at small air gap.
Figure 25:
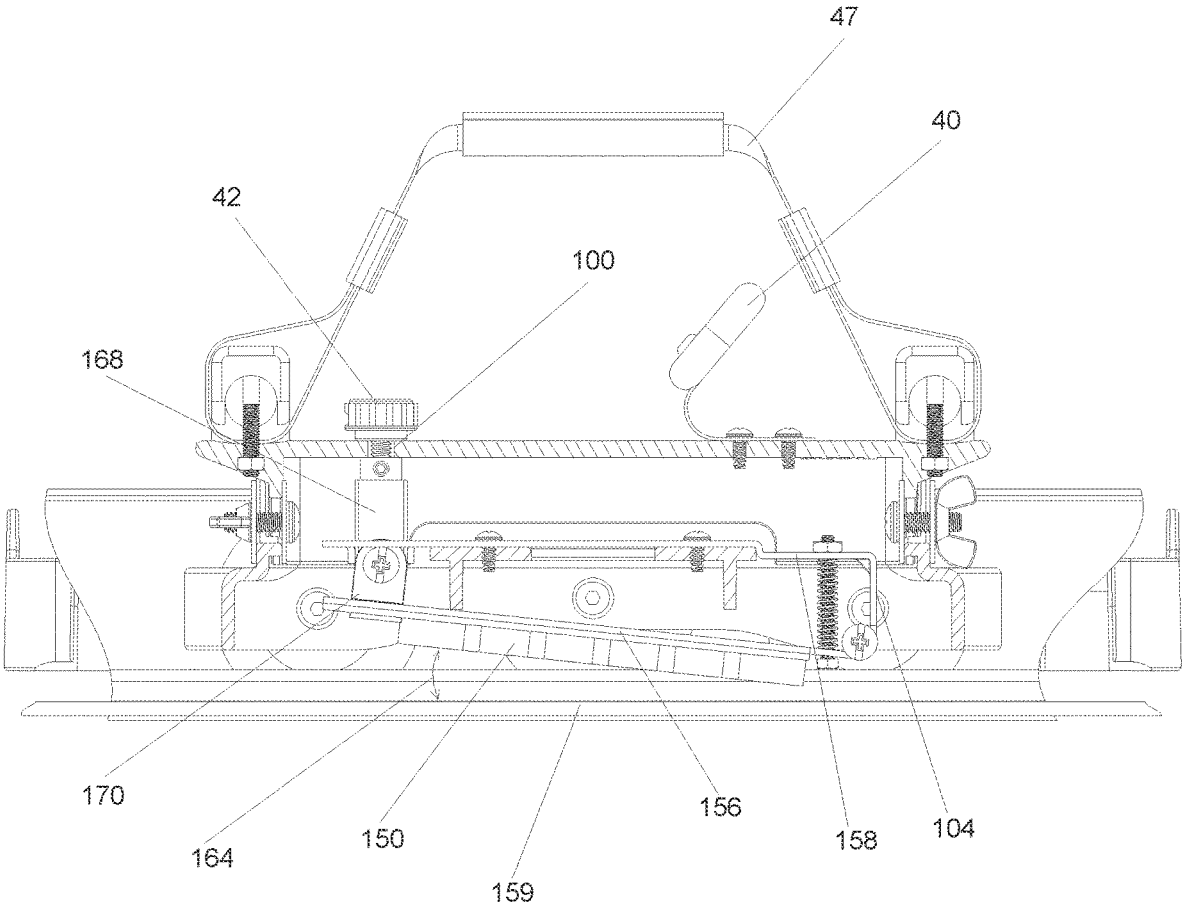
FIG. 25 is a sectional view illustrating the magnetic resistance assembly of third embodiment adjusted at large air gap.

The top portion comprises a plurality of housings 70 with cross section in the form of a lower half circle or rectangle laid along the width of the footrest board 30 to engage with beam caps 72 which are rigid or semi rigid construction pieces and have cross section in the form of an upper half circle or rectangle. A cut 112 in the middle of the housing 70 to make room for a fabric handle 47 to go through for carrying the unit as shown FIG. 21. the lower half housings and the upper half beam caps 70,72 form a circular opening for holding the footrest frame 32. The footrest frame 32 includes a plurality of hat shaped rigid beams or tubes 62, each having two side arms 66 extending horizontally and a middle portion 68. The beams 62 are interconnected by cross tubular beams 64 above the side arms 66 to create a substantial rigid structure for supporting the footrests 23. The footrest frame 32 straddles the footrest board 30 and the middle portions 68 of the beams are clamped between the lower half housings 70 and the upper half beam caps 72. Fasteners are used to connect the beam caps 72 and the footrest frame 32 to the footrest board 30. The tubular beams 64 are connected to the hat shaped beams 62 by welding as in FIG. 12 or by connectors using screws, bolts, or rivets in shown FIG. 2.

Figure 16:
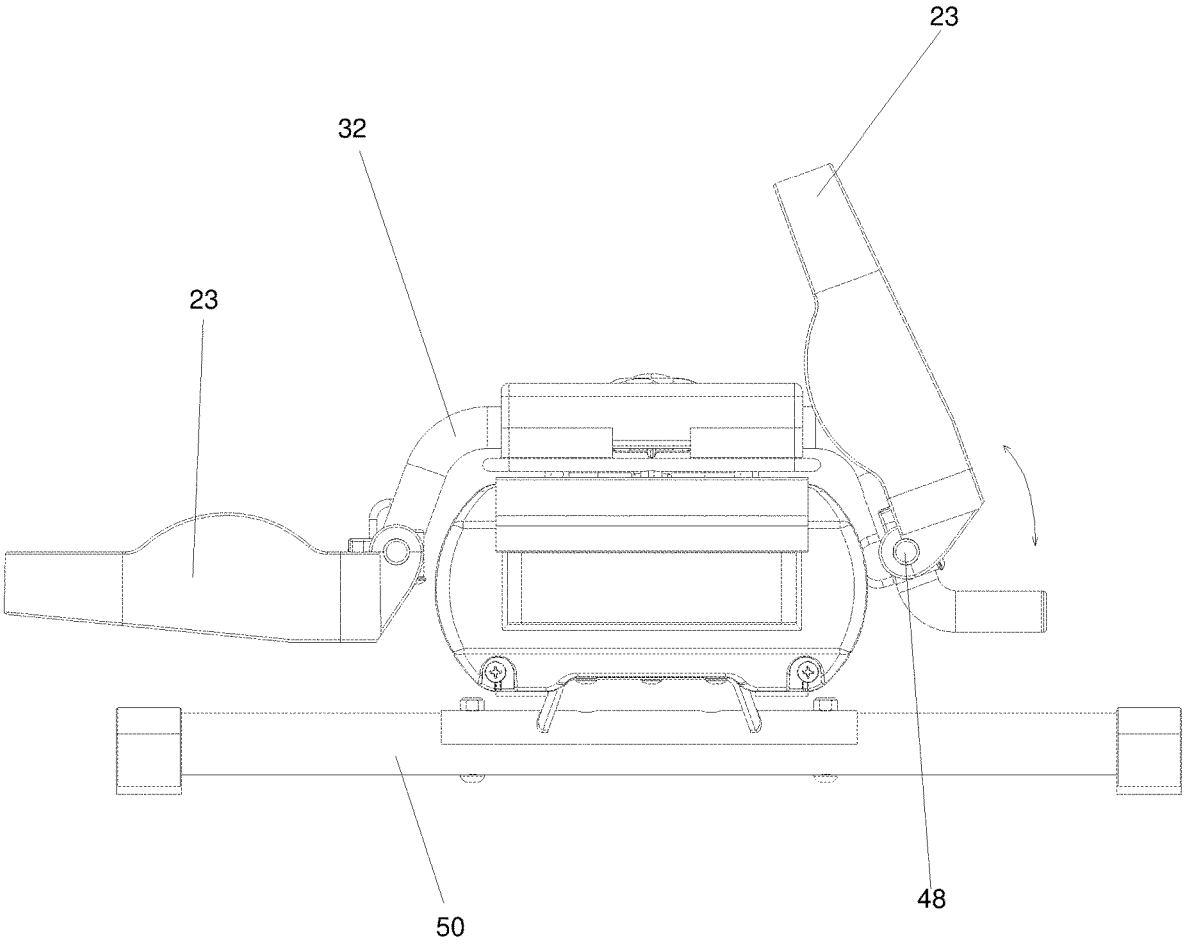
FIG. 16 is a front or rear view of a second embodiment of the exercise device with one footrest folded upward.
Figure 17:
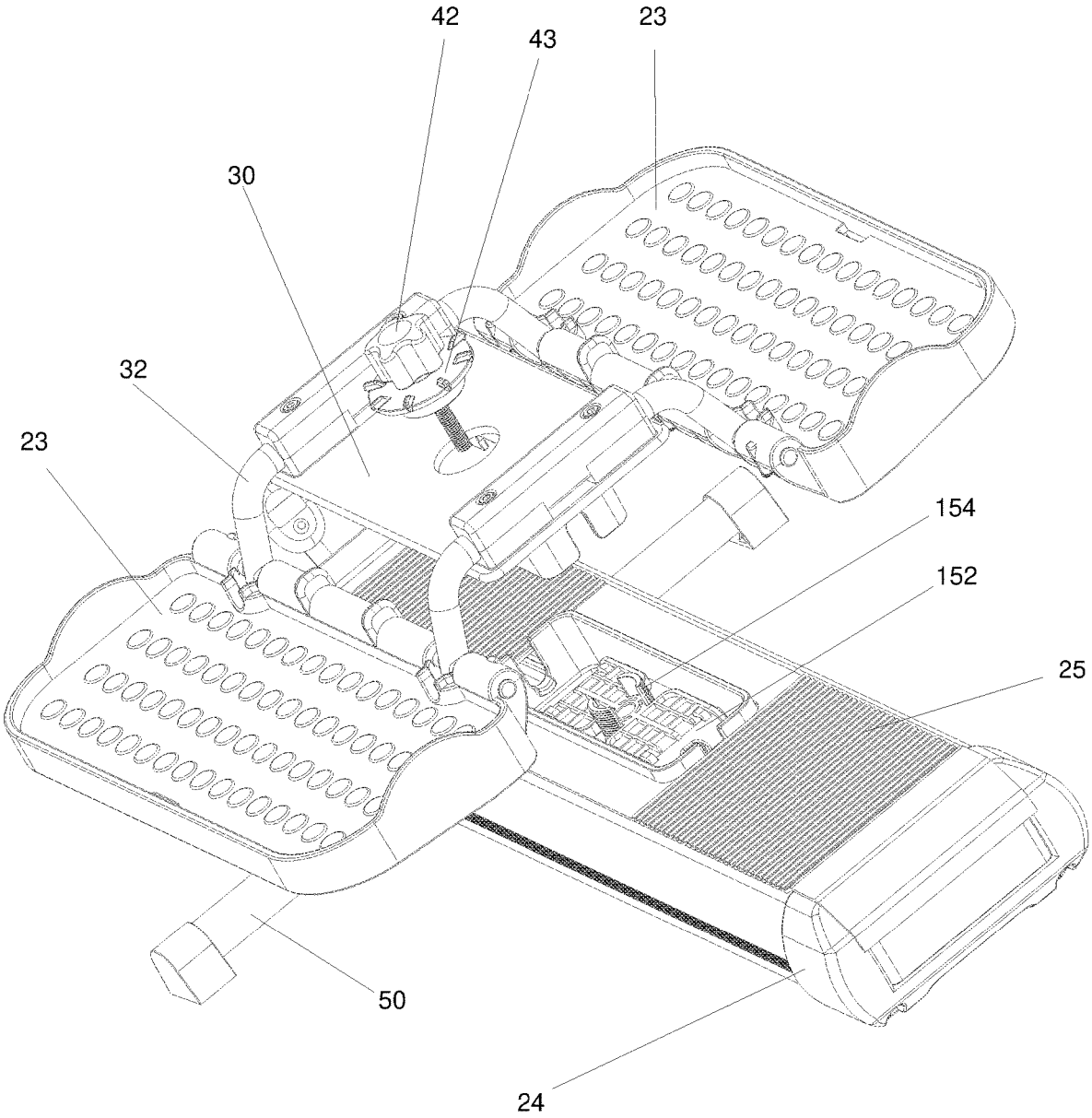
FIG. 17 is a top perspective exploded view of a second embodiment of the exercise device.
Figure 18:
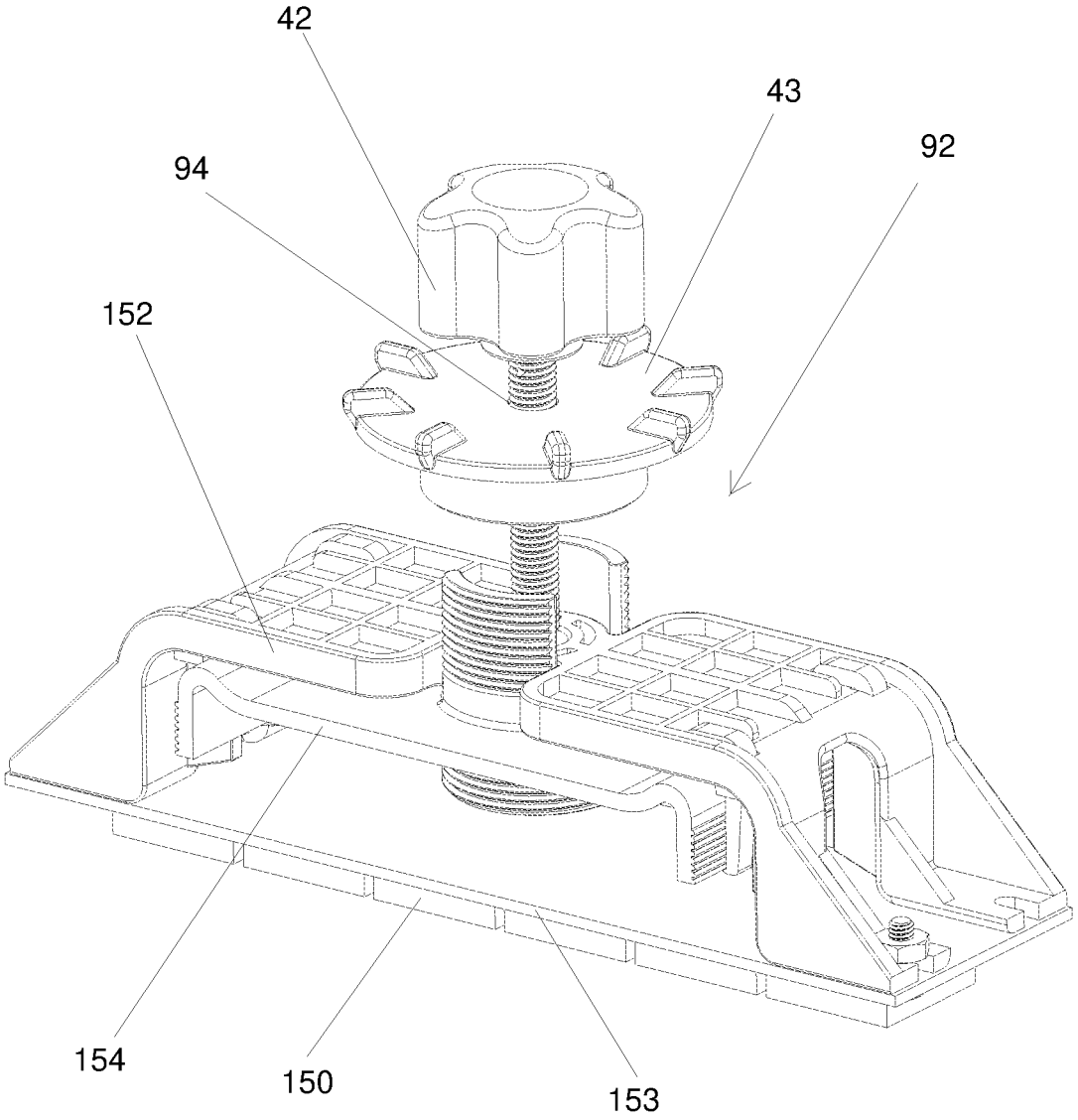
FIG. 18 is a top perspective of a sectional view illustrating the dual resistance assembly of second embodiment of the exercise device.
Figure 19:
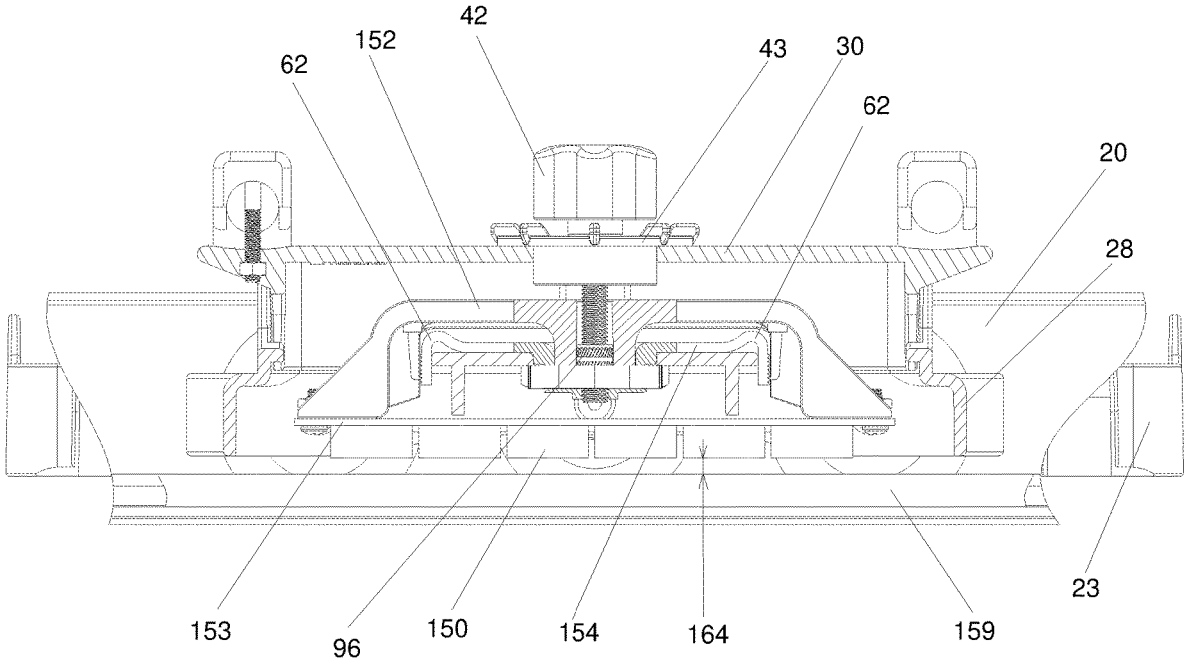
FIG. 19 is a sectional view illustrating the dual resistance assembly of second embodiment adjusted at large air gap.
Figure 20:
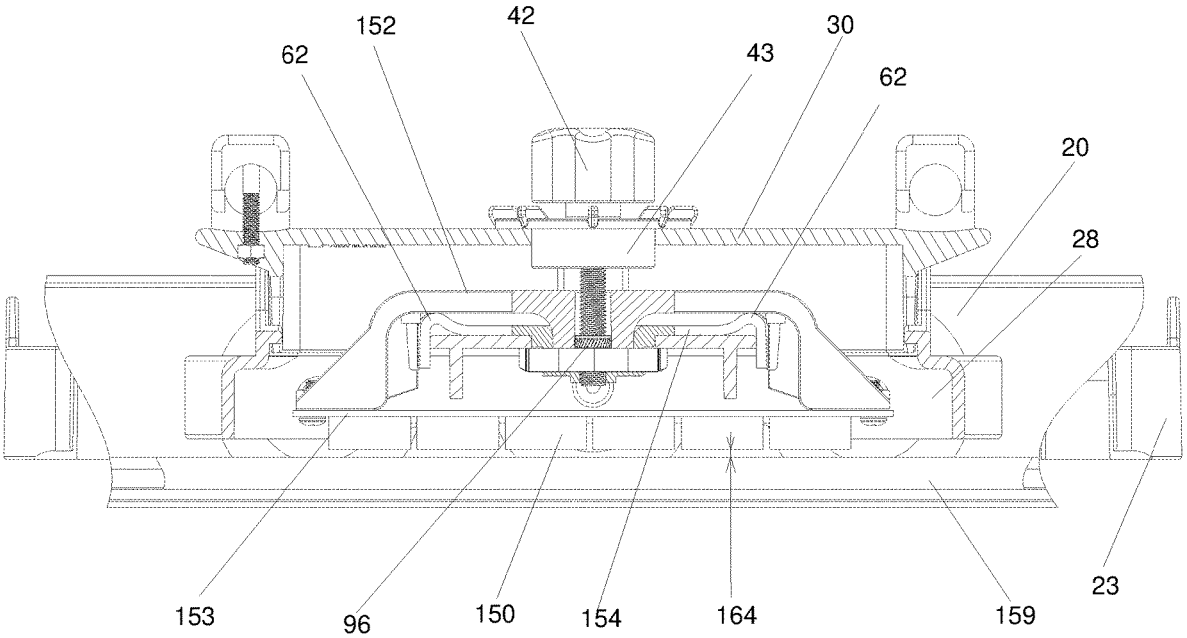
FIG. 20 is a sectional view illustrating the dual resistance assembly of second embodiment adjusted at small air gap.

The footrest sub-assembly 23 comprises mainly of a foot plate 86 and half circle groove 88,89 along the side and length of the foot plate 86. The foot plate 86 contains a plurality of ribs and cross ribs at the bottom to form a substantial structural rigidity for increased stiffness. Hinge caps 90,91 are rigid or semi rigid construction pieces in the form of half circle cylindrical tubes. Hinge caps 90,91 are attached to the foot plate 86 at the grooves 88,89 by fasteners to form a circular opening around the tubular beams 64 and create a hinge for the foot rest to rotatably mount to the footrest frame 32. The foot rest 23 can be rotated to have the grooves 46 in the foot plate 86 engage with the side arms 66 of the footrest frame 32 to restrain the rotary movement of the foot rest 23 in the horizontal position. The foot rest can be folded upward when the unit is not in use as in FIG. 16.

The hat shape and straddle mounting of the footrest frame 32 on the footrest board 30 enable the footrests 23 to be mounted as low as possible to the ground, thereby allowing the user to have more clearance with a desk during exercise.

Referring now to FIGS. 15-20, in different embodiments, the resistance sub-assembly 92 comprising a magnet holder 152, magnet holder guide 154, magnetic holding plate 153, plurality of magnets 150, reaction bar 159, an adjusting tension knob 42, and an elastic resistance element not shown. The magnet holder 152 having a length and width is one piece shaped as a hat with a center cylindrical portion mounted slidably within the magnet holder guide 154. The magnet holder guide 154 has inverted U-shaped cross section with curved peaks 62 like dog ears to serve as pressure points when the elastic element is squeezed between the curved peaks 62 and magnet holder. The adjusting knob 42 with threaded shaft extends downward from the bore 94 in the flanged cap nut 43, then into a threaded insert 96 in the magnet holder 152 or into an internally threaded bore integral to the magnet holder 152. The magnet holding plate 153 having a plurality of magnets 150 laid in an alternate manner as north and south poles to create a magnetic force. The magnet holding plate 153 is attached to the magnet holder 152 by means of fasteners or other appropriate method. Turning the knob 42 for magnetic resistance adjustment drives the whole sub assembly magnet holder 152, magnetic holding plate 153, and magnets 150 in a vertical motion to control the air gap 164 between the magnets 150 and the reaction bar 159. The magnet holder guide 154 is attached to the carriage frame 28 and serves as a guide during the vertical travel of magnet holder 152. The reaction bar 159 is fixed and attached to the end caps means of screws or any other fastening method. One end of reaction bar 159 is attached to a first end cap 24, similarly, the other end of reaction bar 159 attached to a second end cap 24.

Referring now to FIGS. 21-25, in an alternative embodiment, the magnetic resistance sub-assembly 98 comprising of a base arm 158, magnet arm 156, plurality of magnets 150, reaction bar 159, plunger 168, connecting piece 170, and an adjusting tension knob 42. The plunger 168 is one-piece rigid or semi rigid construction in a shape of a rectangular cube with internally threaded bore. The adjusting knob 42 with threaded shaft extends downward from the bore 100 in the footrest board 30, then into a threaded bore integral to the plunger 168. The base arm having a shape of the letter L where the long arm is the base arm 158 which is attached to the carriage frame 28 by fasteners and the short arm 104 pointing downward. The magnet arm 156 is on piece of rigid construction where first end is rotatably mounted to the short arm 104 at the pivot 106 and the second end having a cut is slidably connected to the connecting piece 170. The long arm 102 has a square opening 108 located at one end from which the plunger 168 travels vertically. The connecting piece 170 is one-piece rigid or semi rigid construction with the pivot 110 at one end to and two grooves 112 at the other end. The plunger 168 is connected pivotally at the pivot 110 to the connecting piece 170 which is slidably mounted to the magnet arm 156 at the grooves 112. The knob 42 adjustment drives vertically the plunger 168 to pull or push the connecting piece 170. As a result, the magnet arm 156 pivots upwardly or downwardly. Thereby, controlling the gap 164 between the magnet arm 156 and the reaction bar 159.

Figure 6:
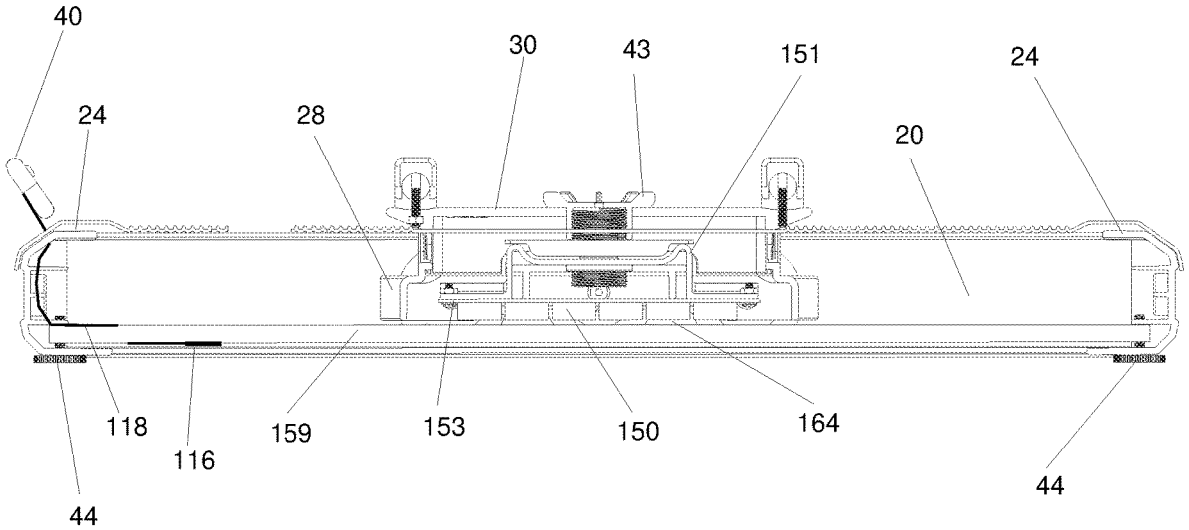
FIG. 6 is a sectional view of one embodiment of the exercise device with air gap adjustment by a wheel at small air gap and with one track removed.
Figure 7:
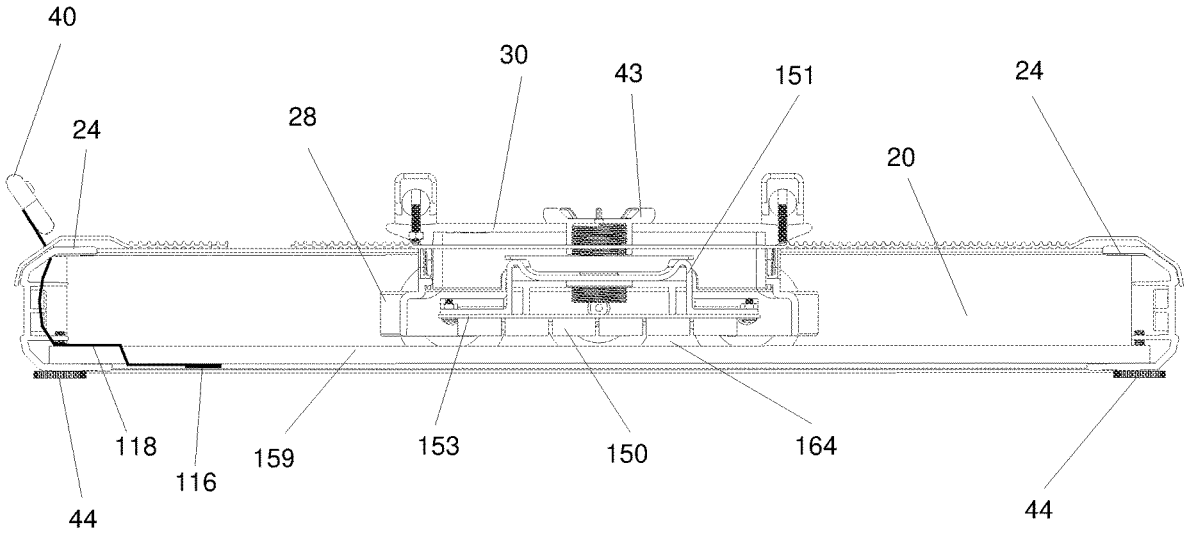
FIG. 7 is a sectional view of one embodiment of the exercise device with air gap adjustment by a wheel at large air gap and with one track removed.
Figure 8:
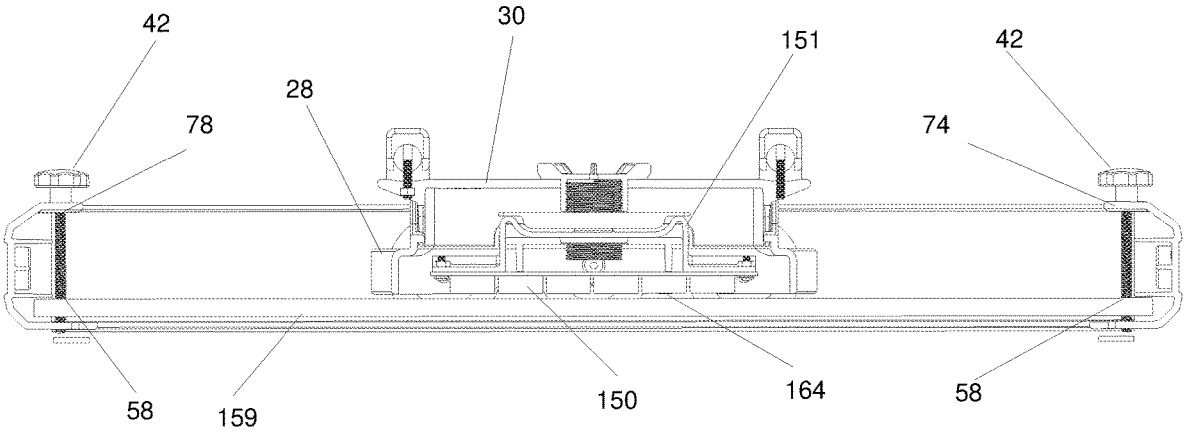
FIG. 8 is a sectional view of second embodiment of the exercise device with air gap adjustment by a knob at small air gap and with one track removed.
Figure 9:
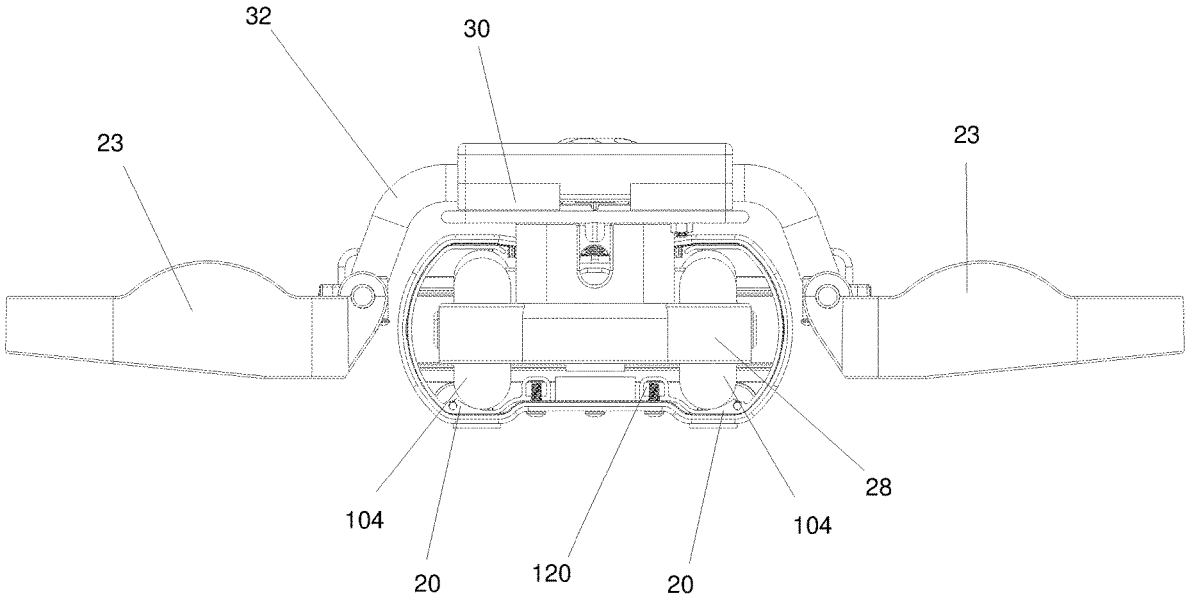
FIG. 9 is a front or rear view of one embodiment of the exercise device with the end cap removed.
Figure 10:
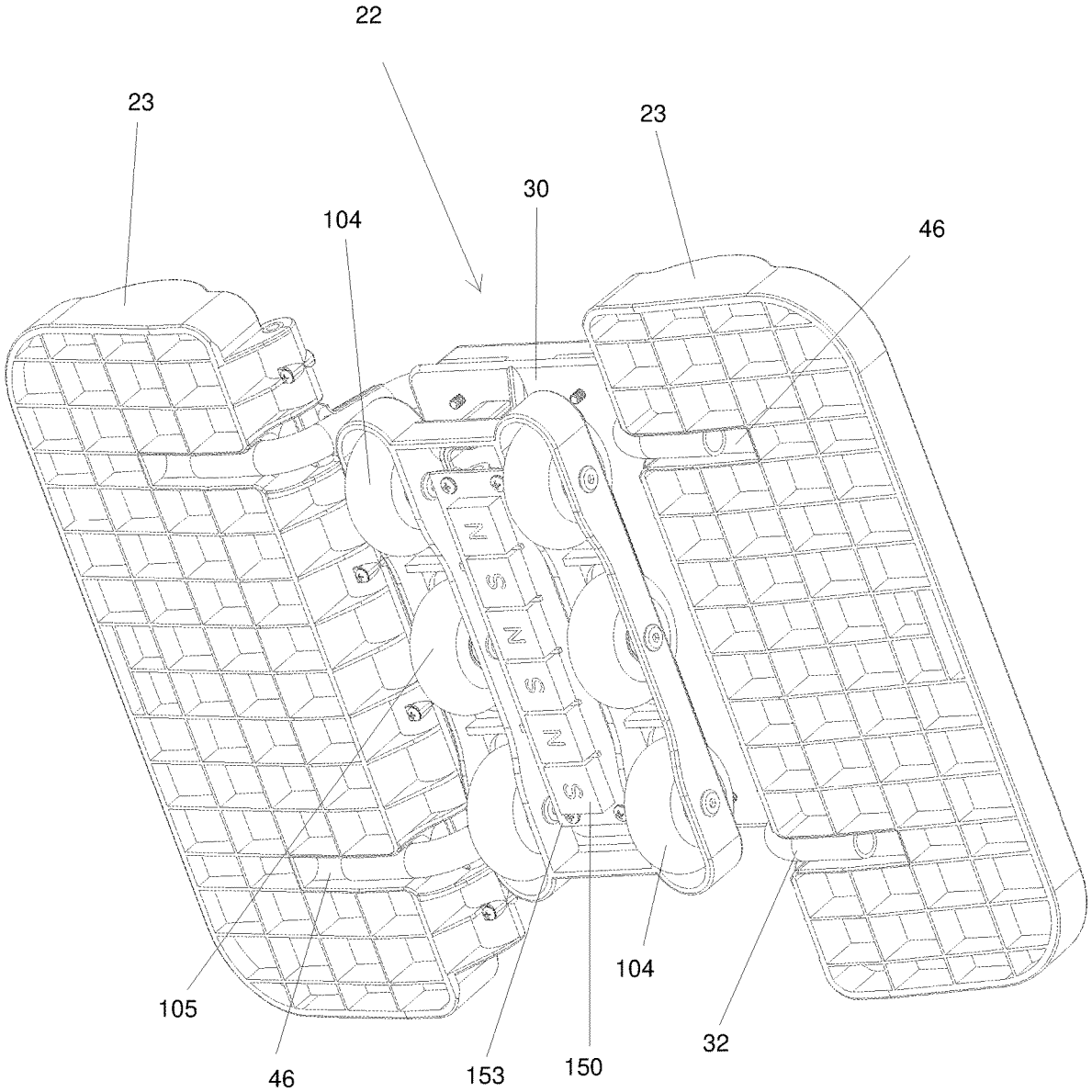
FIG. 10 is a bottom perspective of view of one embodiment of the foot carriage.
Figure 11:
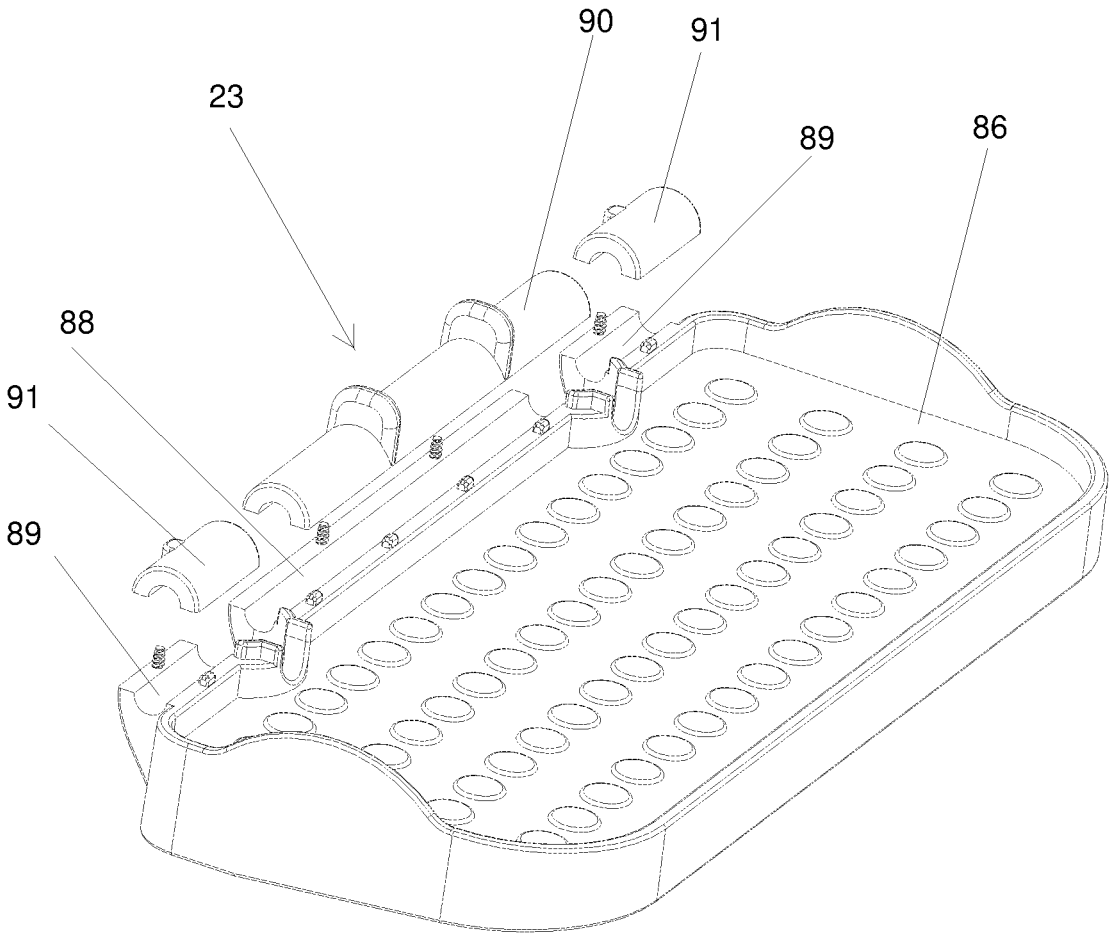
FIG. 11 is an exploded top perspective view of one embodiment of the footrest.
Figure 12:
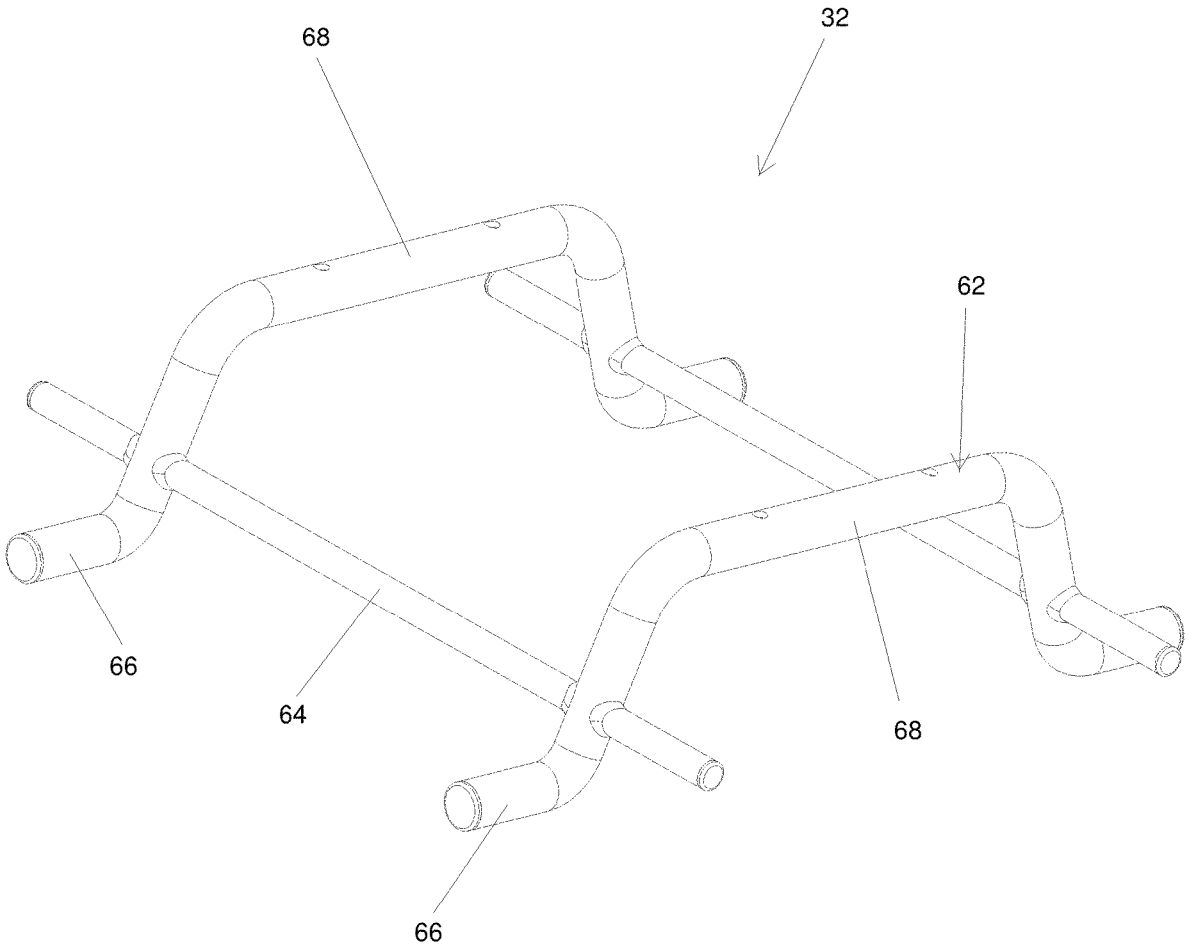
FIG. 12 is a perspective view of second embodiment of the footrest frame.
Figure 13:
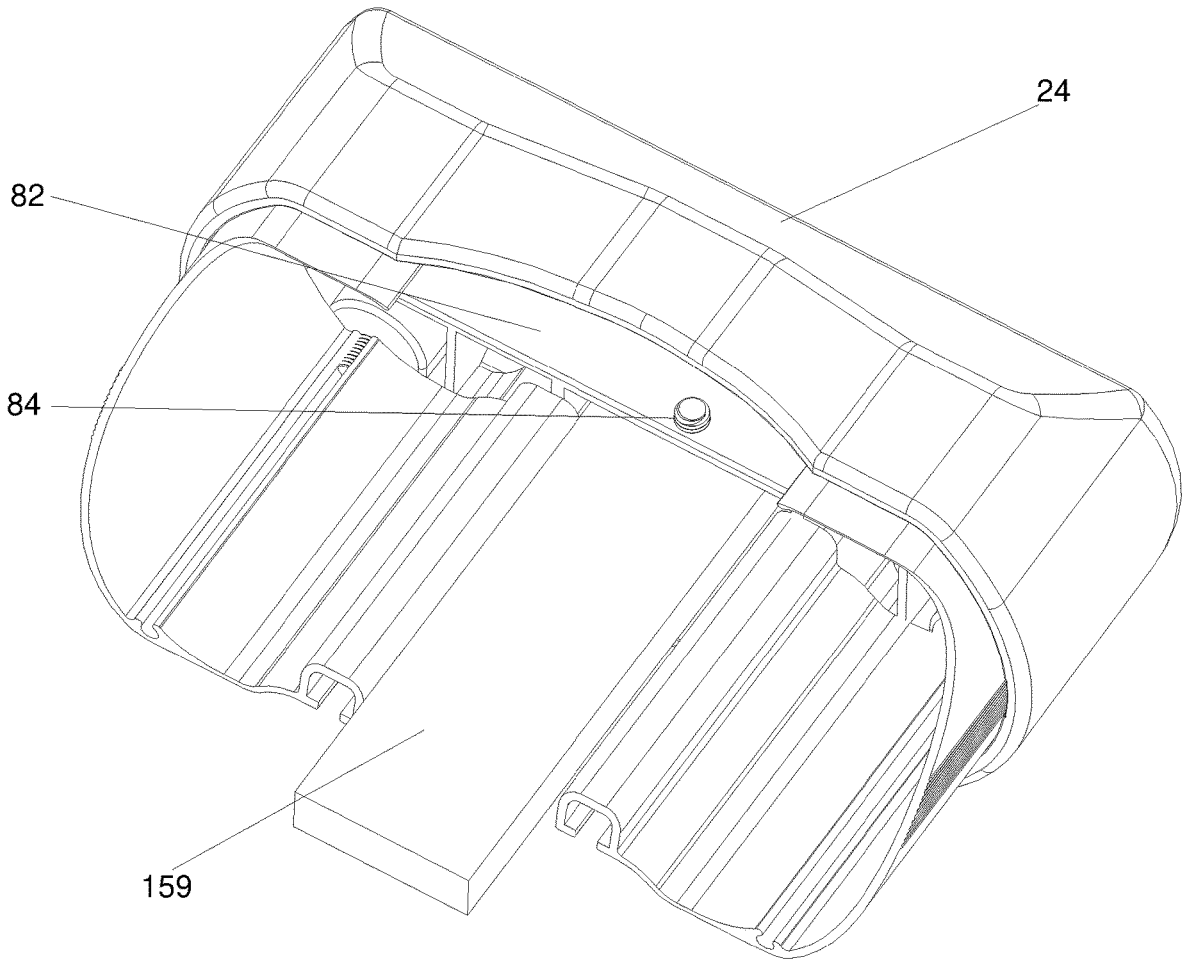
FIG. 13 is a perspective sectional view illustrating the reaction bar, threaded shaft through the endcap wall.
Figure 14:
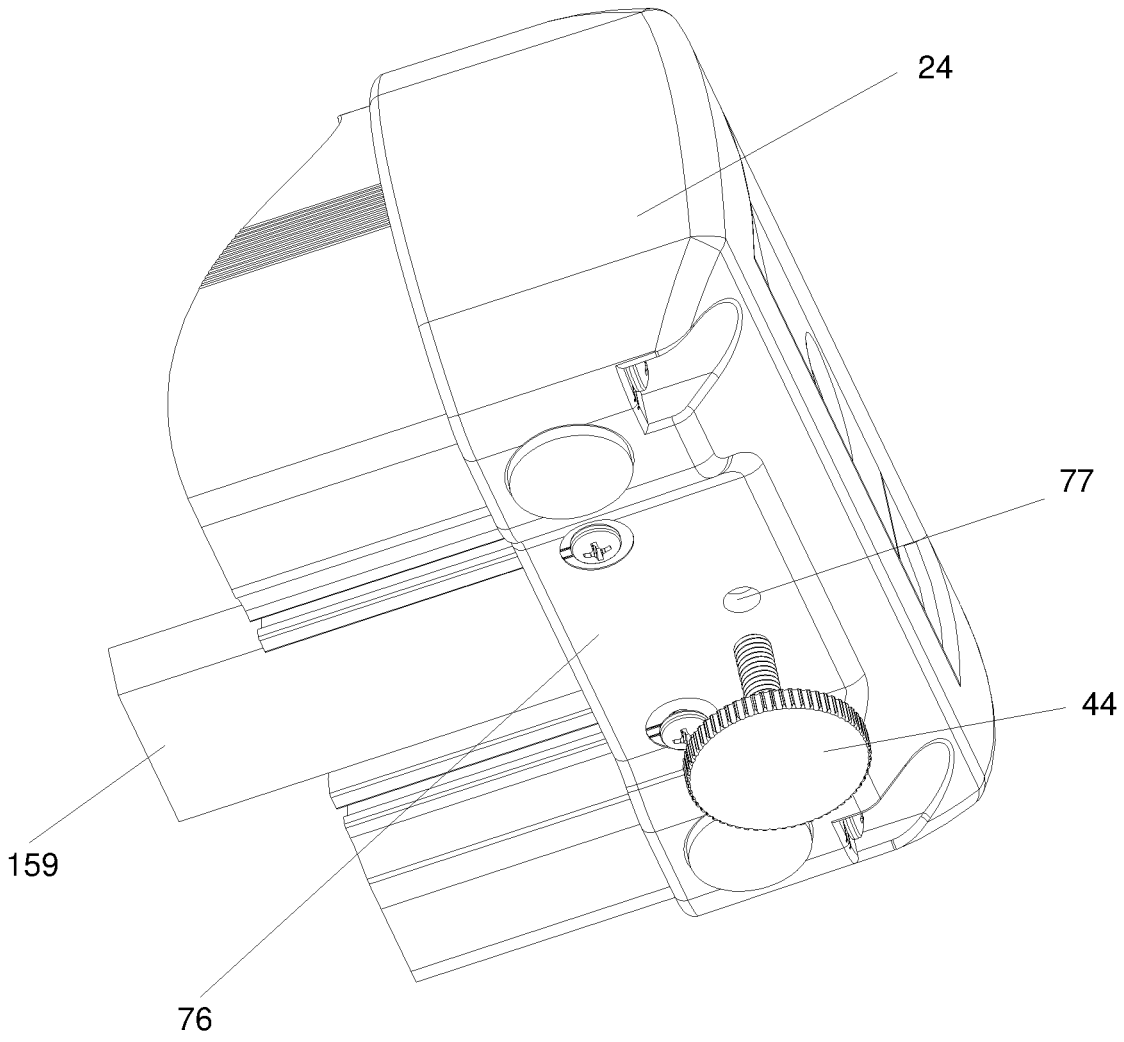
FIG. 14 is a perspective sectional view illustrating the reaction bar, adjusting tension wheel with threaded shaft through the bottom endcap wall.

FIGS. 6,7 show a sensor 116 attached to the reaction bar 159 and connected through wire 118 to using an LCD screen display meter 40 for counting the strides during the exercise.

Figure 15:
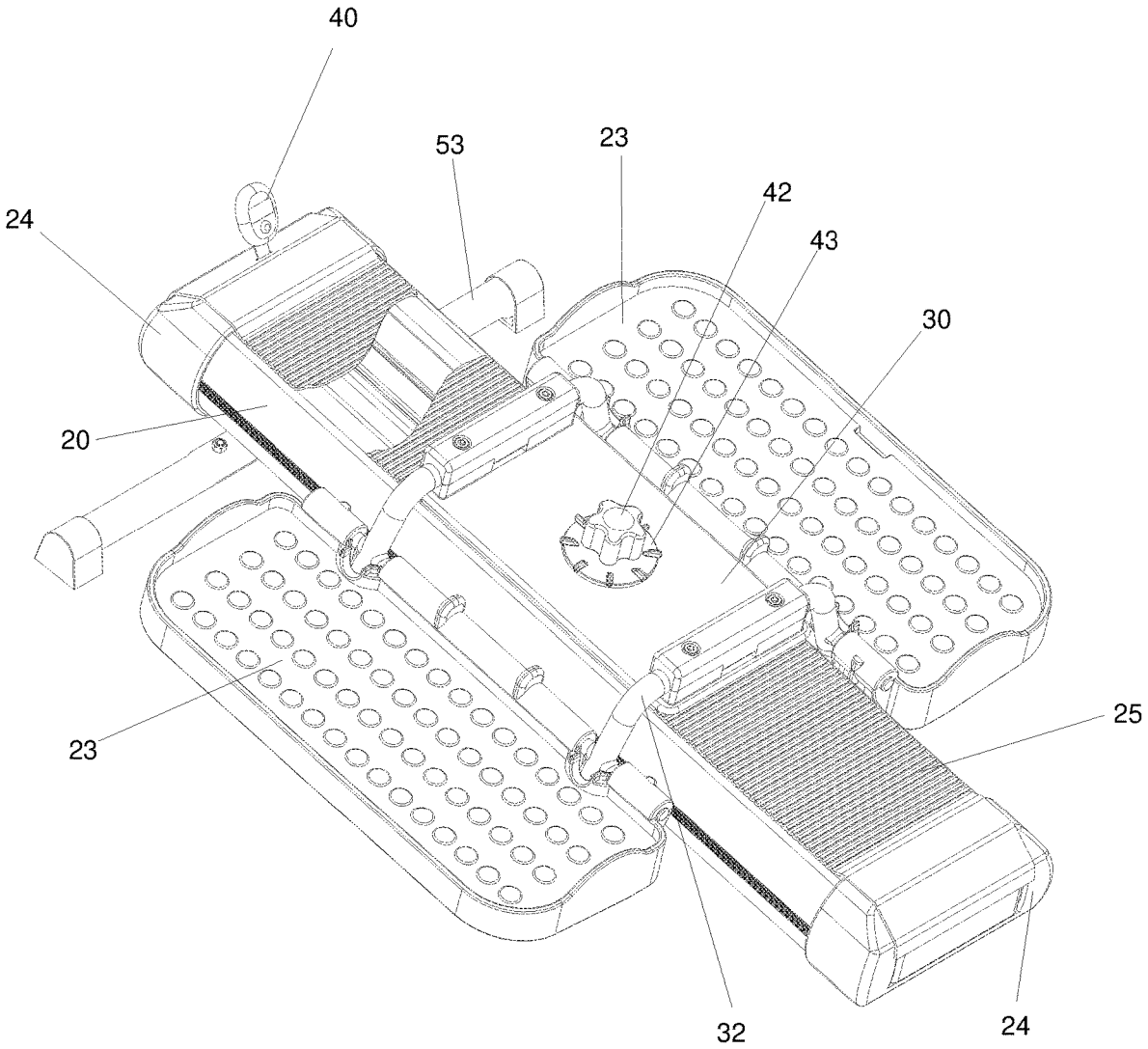
FIG. 15 is a top perspective view of a second embodiment of the exercise device.

FIG. 15 shows a cross bar 53 slidably mounted beneath the tracks 20 to allow for varied inclined positions of the exercise device. The cross bar is mounted to tracks by means screws that thread into square nuts which can slide when untightened along square channels 120 integral to the tracks 20 as in FIG. 9.

While the preferred embodiment of the invention has been illustrated and described, it will be appreciated that various changes, adaptations and modifications may be made therein without departing from the spirit of the invention.

I claim:

1. An exercise device, comprising:

a) a foot carriage comprising a carriage frame with rotatably mounted wheels and a foot support assembly, encompassing a footrest board with specified width and length for which a lower part engages with the carriage frame, while an upper surface of the footrest board is straddle mounted by a footrest frame, which accommodates a pair of footrest assemblies pivotably mounted with hinges, allowing the footrest assemblies to pivot between a low-profile horizontal position and an upward orientation;

b) a dual resistance assembly incorporates magnetic and elastic resistance components that can be engaged either concurrently or independently to impede the movement of the foot carriage along a track assembly with a first end and second end; and c) a cross bar slidably mounted beneath a track assembly to allow for variable inclined positions of the exercise device.

2. The exercise device of claim 1 in which the footrest frame is a structure having a plurality of hat-shaped rigid beams that are spaced apart, each hat-shaped beam consists of two side arms extending horizontally and a central part.

3. The exercise device of claim 2 in which the hat-shaped rigid beams are linked by a plurality of cross-tubular beams positioned above the footrest frame's side arms, forming a notably sturdy structure with a first end and a second end.

4. The exercise device of claim 3 in which the upper surface of the footrest board includes a plurality of grooves across its width, connecting with beam caps once the footrest board is straddle-mounted by the footrest frame and the central parts of the hat-shaped beams are secured between the footrest board's grooves and the beam caps using fasteners.

5. The exercise device of claim 1 in which the footrest assembly includes a flat surface designed to receive the user's foot, featuring a longitudinal groove on its upper side with a semi-circle cross section, to which beam caps are affixed using fasteners, these caps having a cross-sectional shape resembling the upper half of a circle, forming a hinge with a circular opening for rotatably mounting footrest assembly to the footrest frame.

6. The exercise device of claim 1 in which the dual resistance assembly comprises a magnet holder having a lengthwise hat-shaped cross section with curved peaks and two horizontally extending sides and a center bottom threaded cylindrical part that is attached to the carriage frame by fasteners, a magnet holding plate, a pressure plate, reaction bar with a first end and second end and made of conductive material, and an elastic resistance element.

7. The exercise device of claim 6 in which the magnet holder is attached by fasteners to the magnet holding plate which holds a plurality of magnets to interact with the reaction bar for which the first end is adjustably connected to the first end and of the track assembly and second end is adjustably connected to the second end of the track assembly, allowing for vertical adjustment thus magnetic resistance variation through a threaded shaft connected to a tension wheel at each end of the track assembly.

8. The exercise device of claim 6 where the elastic resistance component takes the form of a removable elastic band or tube releasably attached between the track assembly's ends and pressed against the magnet holder at two curved peaks by the pressure plate, and its vertical movement that is initiated by securing a flanged cap nut, offering resistance control through modification of the elastic resistance component's length and allowing the engagement of magnetic and elastic resistance concurrently or independently.

9. The exercise device of claim 1 comprises a magnet holder slidably mounted within a magnet holder guide that is attached to the carriage frame, magnet-holding plate with magnets, reaction bar affixed to the track assembly ends, and an adjusting tension knob with a threaded shaft extending downwards from a bore on the flanged cap nut, subsequently entering a threaded hole in the magnet holder to govern the magnet holder's vertical motion, altering magnetic resistance by regulating the gap between the magnets and the reaction bar.

10. The exercise device of claim 1 where the magnetic resistance component is comprised of a base arm resembling the letter L, featuring a lengthy arm connected to the carriage frame and a downward-pointing short arm pivotally attached to a magnet arm equipped with magnets, a reaction bar fixed to the track assembly's ends, a plunger hosting an internally threaded bore, a connecting piece affixed in a sliding manner to the magnet arm and pivotally attached to the plunger, in addition to an adjusting tension knob featuring a threaded shaft that enters the plunger's threaded bore, enabling the modification of the air gap between the magnet arm and the reaction bar.

* * * * *